US012232632B2

(12) United States Patent
Sherman

(10) Patent No.: US 12,232,632 B2
(45) Date of Patent: Feb. 25, 2025

(54) SELF-COVERING OUTDOOR FURNITURE

(71) Applicant: Gary Donald Sherman, Medfield, MA (US)

(72) Inventor: Gary Donald Sherman, Medfield, MA (US)

( * ) Notice: Subject to any disclaimer, the term of this patent is extended or adjusted under 35 U.S.C. 154(b) by 132 days.

(21) Appl. No.: 18/109,907

(22) Filed: Feb. 15, 2023

(65) Prior Publication Data

US 2024/0057775 A1 Feb. 22, 2024

Related U.S. Application Data

(60) Provisional application No. 63/310,640, filed on Feb. 16, 2022.

(51) Int. Cl.
*A47C 7/66* (2006.01)
*A47C 1/00* (2006.01)

(52) U.S. Cl.
CPC ..... *A47C 7/666* (2018.08); *A47C 1/00* (2013.01)

(58) Field of Classification Search
CPC ..... A47C 1/00; A47C 17/04; A47C 11/00; A47C 13/00; A47C 7/62; A47C 7/66; A47C 7/666
See application file for complete search history.

(56) References Cited

U.S. PATENT DOCUMENTS 5,564,784 A * 10/1996 Felling ..... A47C 7/66 280/79.5
2019/0133336 A1* 5/2019 Ennis ..... A47C 31/11

FOREIGN PATENT DOCUMENTS

CN 109106126 A * 1/2019 ..... A47C 1/00

* cited by examiner

*Primary Examiner* — Milton Nelson, Jr.
(74) *Attorney, Agent, or Firm* — Louis J. Franco; Law Office of Louis J. Franco

(57) ABSTRACT

A self-covering outdoor furniture unit configured for human seating includes a seating surface and a backrest extending upwardly from the seating surface. Carried by the furniture unit is a substantially planar and rigid weather-protective panel. The panel is retained by guide members for linear displacement behind the backrest between a lowermost, storage position and an uppermost position, with the panel in a vertical orientation in which the panel is substantially perpendicular to the seating surface. When the panel is in the uppermost position, it can be pivoted forwardly into a deployed position in which it is disposed substantially horizontally over the seating surface, thereby shielding the seating surface from precipitation, blown debris, and sunlight.

21 Claims, 7 Drawing Sheets

SELF-COVERING OUTDOOR FURNITURE

Priority based on Provisional Application Ser. No. 63/310,640 filed Feb. 16, 2022, and entitled "SELF COVERING OUTDOOR FURNITURE" is claimed. Moreover, the entirety of the previous provisional application, including the drawings, is incorporated herein by reference as if set forth fully in the present application.

BACKGROUND

Outdoor seating enhances the enjoyment of outdoor spaces such as decks and patios. While outdoor furniture units such as chairs and couches are constructed to endure some exposure to environmental and atmospheric elements such as rain and sunlight, exposure nevertheless results in the undesirable deposit and accumulation of debris like leaves, pollen, dirt, tree sap, etc. Deposits such as these often require users to clean the furniture before use, which is not conducive to spontaneous enjoyment. Moreover, and perhaps worst of all, prolonged exposure to sunlight and, in particular, ultraviolet radiation, greatly accelerates the degradation of outdoor furniture.

Owners of outdoor furniture have taken measures to counter these difficulties and inconveniences. One solution has been to cover furniture after each use. This is sometimes done with covers especially made for the purpose. However, covering and uncovering furniture after and before each use is hardly convenient, and otherwise presents the issue of folding and storing furniture covers when the furniture is in use. Another solution that is also accompanied by great inconvenience is removing and storing furniture cushions after each use.

Accordingly, a need exists for a self-covering outdoor furniture unit that is configured for human seating and incorporates a readily deployable and stowable weather-protective cover.

SUMMARY

Broadly conceived, and illustratively embodied, a self-covering outdoor furniture unit is configured for human seating. In one version, the furniture unit is embodied as a chair configured for seating a single person. Each of various alternative versions is generally configured as a couch configured to accommodate seating by multiple (two or more) persons.

Regardless of the number of persons any specific version is designed to accommodate, a first embodiment generally illustrative of the invention includes a first side portion having a first side wall and a first-side upper surface and a second side portion laterally opposite the first side portion and having a second side wall and a second-side upper surface. More specifically embodied, each of the first-side and second-side upper surfaces defines an armrest.

The furniture unit further includes a base configured for setting upon a substantially horizontal furniture-support surface such as a deck or patio. The base includes a seating surface extending laterally between the first and second side portions. The seating surface is configured to accommodate at least one seated person thereon. Along a furniture-unit rear portion, a backrest extends upwardly above the seating surface and laterally between the first and second side portions. The seating surface extends forwardly of the furniture-unit rear portion and the backrest toward a furniture-unit front face, at least a portion of which would extend behind the calves of a person seated on the seating surface.

Each of various versions incorporates a self-supporting, substantially rigid weather-protective panel. The weather-protective panel has opposed panel inner and outer surfaces that coextend along a panel plane between a panel rearward-lower edge, a panel forward-upper edge opposite the rearward-lower edge, and laterally opposed panel first and second edges that extend between the panel rearward-lower and forward-upper edges. The weather-protection panel is oriented such that the panel rearward-lower and forward-upper edges extend laterally between the first and second side portions of the furniture unit. The panel rearward-lower and forward-upper edges are designated as such for reasons that will be more fully elucidated later in the present specification, and through conjunctive reference to various drawings. Presently, however, it is sufficient to note that, in one panel orientation, the forward-upper edge is spatially disposed above the rearward-lower edge while, in another panel orientation, the forward-upper edge is spatially disposed forwardly the rearward-lower edge.

The weather-protective panel, while adjoined to the remainder of the furniture unit, is moveable between storage and use (deployed) positions. More specifically, according to each of various embodiments, the panel rearward-lower edge is retained for linear displacement behind the backrest between a lowermost position and an uppermost position. When the panel rearward-lower edge is disposed in the uppermost position, the panel can be pivoted about a panel-pivot axis between vertical and horizontal orientations relative to the furniture-support surface. The vertical orientation is such that the panel forward-upper edge is disposed above the panel rearward-lower edge, while the horizontal orientation is such that the panel forward-upper edge is disposed forwardly of the panel rearward-lower edge. Although specifics of enabling mechanical elements may vary across alternative embodiments, retention of the panel rearward-lower edge for vertical displacement behind the backrest broadly involves the inclusion of a set of tracks or guiderails, illustrative, nonlimiting examples of which are described later in the present specification and depicted in various drawings.

By virtue of the aforesaid linear displaceability and pivotability, the weather-protective panel can be linearly and pivotably displaced between storage and deployed positions. In the storage position, the panel is vertically disposed behind the backrest such that the panel plane is substantially perpendicular to the furniture-support surface with the weather-protective panel rearward-lower edge in its lowermost position. In the deployed position, the panel is horizontally disposed above the seating surface such that the panel plane is substantially parallel to the furniture support surface. In each of various versions, the deployed position is such that the weather-protective panel is supported above the seating surface by, and extends between, at least the first-side and second-side upper surfaces. According to a still-more-specific design variation, the backrest includes a backrest upper surface that is substantially coplanar with the first-side and second-side upper surfaces such that, when in the deployed position, the weather-protective panel is furthermore supported above the seating surface by the backrest upper surface.

When deployed, the weather-protective panel shields from above the seating surface from precipitation, sun, leaves, pine needles, tree cap, etc. However, because, in various embodiments, the deployed panel is supported by at least the first-side and second-side upper surfaces, which will typically be disposed at a higher elevation than the seating surface, there is a resultant frontal opening at the front of the furniture that extends laterally and vertically between and within, respectively, (i) the first and second side portions and (ii) the seating surface and the panel inner surface. Left uncovered, this frontal opening would leave the seating surface at least partially exposed to blown debris and precipitation, as well as sunlight entering at an angle during, for example, morning or early evening sunlight hours.

Accordingly, each of various versions further includes a weather-protective subsidiary panel depending from the forward-upper edge of the weather-protective panel. Relative to versions of the furniture unit further including a weather-protective subsidiary panel, the element that has up to this point been designated simply as "weather-protective panel" may be alternatively and interchangeably referred to as the "weather-protective primary panel." Moreover, for simplicity, the weather-protective primary and subsidiary panels may by alternatively and interchangeably referred to as, respectively, the primary and subsidiary panels. Additionally, and especially when embodiments including primary and subsidiary panels are being described, sub-elements or portions of each may be identified by panel-indicative hyphenated modifiers. By way of a single illustrative example, while designation of the "panel rearward-lower edge" of the "weather-protective panel" is clear relative to embodiments not including a subsidiary panel, relative to embodiments including primary and subsidiary panels, this portion of the primary panel may be referred to instead as "primary-panel rearward-lower edge." In short, some variation, flexibility, and interchangeability in referencing any particular element or sub-portion of an element is exercised, but this is done in a way that is nevertheless clear, logical, and, most importantly, consistent within any particular series of claims beginning with an independent claim and including claims dependent thereon.

Although embodiments in which the subsidiary panel, like the primary panel, is also substantially rigid and self-supporting are not outside the scope of the invention as envisioned and claimed—in the absence of explicit claim limitations to the contrary—it is generally advantageous for the subsidiary panel to be fabricated from a flexible material—at least relative to the material from which the primary panel is fabricated—such as, by way of non-limiting example, canvas or a polymeric material like nylon or polypropylene. A flexible subsidiary panel may be regarded as a kind of curtain. A flexible subsidiary panel facilitates ease of storage and simplifies deployment of both the primary and subsidiary panels. Because, in either the deployed or storage position, the subsidiary panel most commonly hangs down from the panel forward-upper edge of the primary panel, the edge of the subsidiary panel by which it is attached to and depends from the forward-upper edge of the primary panel is referred to as the subsidiary-panel top edge. Opposite the subsidiary-panel top edge is a subsidiary-panel bottom edge. The subsidiary-panel top and bottom edges extend substantially parallel to one another and laterally between laterally opposed subsidiary-panel first and second edges. The subsidiary-panel first and second edges generally correspond to the panel first and second edges of the primary panel.

In each of various versions, one or more of (i) the rearward-lower edge and/or the forward-upper edge of the primary panel and (ii) the subsidiary-panel bottom edge is/are provided an elongated, laterally extending reinforcement member. In each case, the reinforcement member provides rigidity to the edge of which it forms a part. While not all embodiments may include a reinforcement member corresponding to each of the aforementioned edges, in an illustrative embodiment in which all three of the aforesaid edges include reinforcement members, the reinforcement members relative to the rearward-lower edge, the forward-upper edge, and the subsidiary-panel bottom edge are designated as, respectively, first, second, and third reinforcement members. Variously configured, each reinforcement member may be fabricated from any suitable material that provides functional rigidity including, but not limited to, PCV, metal, or wood.

While the main purpose of the second reinforcement member is to provide rigidity to the panel forward-upper edge and, in some cases, to provide a place to attached the subsidiary-panel top edge and keep it stretched out laterally, in each of various versions, the first and third reinforcement members serve additional functions. More specifically, the third reinforcement member is attached along the subsidiary-panel bottom edge, and both (i) keeps the subsidiary-panel bottom edge stretched out laterally and substantially parallel to the subsidiary-panel top edge and (ii) provides weight to maintain the subsidiary panel stretched out and hanging vertically in both its deployed and stored positions. The subsidiary panel is preferably dimensioned such that, when it and the primary panel are in the deployed positions, the subsidiary-panel bottom edge is situated below at least the seating surface so as the cover and close off and protect from debris and weather elements the entirety of the frontal opening.

While the weight of the third reinforcement member itself assists in maintaining the subsidiary panel over the frontal opening, some embodiments additionally include attachment elements configured to temporarily and removably retain the subsidiary-panel bottom edge in contacting engagement with a front face of the furniture unit (hereinafter, "furniture-unit front face"), preferably in locations below the seating surface. Illustratively, the attachment elements may include at least one of (i) magnetic elements, (ii) a plurality of hook-and-loop fasteners such as those of the type commonly sold under the trademark Velcro®, and (iii) snaps. While hook-and-loop fasteners are suited to the purpose, they can degrade from debris, use, and exposure to ultraviolet light over time. Accordingly, providing for selective magnetic securement of the subsidiary-panel bottom edge to the furniture-unit front face is preferred over the use of hook-and-loop fasteners. The magnetic elements employed to achieve magnetic securement may be limited to permanent magnets or may include some combination of permanent magnets and metal elements to which permanent magnets are magnetically attracted.

As previously discussed, the panel rearward-lower edge is retained for linear vertical displacement behind the backrest between a lowermost position and an uppermost position. Also previously mentioned was that this restrictive retention involves the inclusion of a set of tracks or guiderails. It is an additional function of the first reinforcement member to facilitate this guided vertical displacement. More specifically, in each of various embodiments, the furniture unit includes laterally opposed and spatially separated first-side and second-side guide members, which may, for example, be in the form or tracks or rails. Illustratively configured, the first and second side portions of the furniture unit include, respectively, first-side and second-side rear surfaces. Attached, defined by, or otherwise carried by the first-side and second-side rear surfaces are, respectively, the first and second guide members.

Illustratively, the first reinforcement member extends laterally beyond each of the opposed primary-panel first and second edges so as to define, respectively, rearward-lower edge first and second protrusions. In at least one version, each of the rearward-lower edge first and second protrusions terminates in a roller, but this need not be the case. In any event, the rearward-lower edge first and second protrusions functionally cooperate with, respectively, the first-side and second-side guide members such that the first-side and second-side guide members define the path of vertical displacement along which the rearward-lower edge is selectively movable between the lowermost and uppermost positions. In each of at least some more specific versions, the primary-panel rearward-lower edge, and the associated first reinforcement member, can be linearly displaced between rearward and forward positions as defined by the first-side and second-side guide members. This may be achieved by each of the first-side and second-side guide members including a curvature adjacent the uppermost position of the rearward-lower edge, or by being substantially L-shape. According to one such version, when the primary panel is displaced vertically upward from its storage position, and the panel rearward-lower edge attains its uppermost position, the primary panel can be both pivoted and linearly displaced forwardly toward the deployed position.

Depending on dimensions and the material(s) from which the primary panel of any particular embodiments is fabricated, the primary panel may be of substantial weight, and difficult for many people to raise. Lifting may be further complicated by the fact that—as revealed from experimentation with prototypes—a very natural way to lift the panel from the storage position toward the deployed position involves a user's steadying himself or herself on or above the seating surface with one hand while lifting the primary panel by the forward-upper edge with the other hand. That is, it is envisioned that, in many instances, a user will seek to lift the primary panel with one hand and arm, which could prove difficult for many people. In response to this potential issue, each of various embodiments includes a lift-assist assembly that reduces the "apparent weight" of the primary panel.

A lift-assist system mechanically linked to the primary panel may employ a variety of alternative mechanical elements such as pulleys, counterweights and/or springs, and any of a variety of flexible mechanical linkages to transfer potential energy stored by a spring or a lifted counterweight to counter a portion of the weight force downwardly exerted by the primary panel by virtue of the earth's gravitational field. While a mutually cooperative assemblage of pulleys, counterweights, and flexible mechanical linkages such as, by way of nonlimiting example, cables, chains, cords, strings, ropes, belts, and/or straps could achieve the desired function of reducing the apparent weight of the primary panel, the use of counterweights is disadvantageous because their inclusion would add undesirable mass and weight to the overall furniture unit. Accordingly, a lift-assist system inclusive of one or more springs is indicated.

Each of various lift-assist systems stores within a spring potential energy of increasing magnitude as the weather-protective primary panel and primary-panel rearward-lower edge are vertically displaced toward, respectively, the storage and lowermost positions. Conversely, the spring releases stored potential energy as the weather-protective primary panel and primary-panel rearward-lower edge are vertically displaced toward, respectively, the deployed and uppermost positions. In this way, the apparent weight of the weather-protective primary panel is reduced by the release and harnessing of the potential energy stored by the lift-assist system.

Although the deformation of springs of various types may be employed to selectively store and release energy to provide a restorative force that counters a portion of the primary panel's weight, a particularly elegant and advantageous design implements a torsion spring. Illustratively, a torsion-spring-driven lift-assist system includes a main shaft mounted behind the backrest of the furniture unit for bidirectional rotation about a main-shaft rotation axis along which the main shaft extends lengthwise, and laterally between the first and second side portions of the furniture unit. The torsion spring is helically disposed about a portion of the lengthwise extent of the main shaft. At least a first drive pulley is affixed to the main shaft for rotation about the main-shaft rotation axis in tandem with the main shaft. A first flexible linkage mechanically linking the first drive pulley to the weather-protective primary panel transfers energy between the torsion spring and panel in the manner subsequently described.

By means of the first flexible linkage, rotation of the main shaft in a first rotation direction causes the torsion spring to deform from a first configuration toward a second configuration and store potential energy. Rotation of the main shaft in a second rotation direction opposite the first rotation direction causes the torsion spring to return from the second configuration toward the first configuration and release potential energy. The first flexible linkage is linked to the first drive pulley and the weather-protective primary panel such that (i) as the primary panel is vertically displaced toward the storage position, the main shaft is rotated in the first rotation direction in order to cause the torsion spring to store potential energy and (ii) as the primary panel is vertically displaced away from the storage position, the main shaft is rotated in the second rotation direction in order to cause the torsion spring to release stored potential energy and assist a user lifting the primary panel by reducing the apparent weight of said primary panel.

Representative embodiments are more completely described and depicted in the following detailed description and the accompanying drawings.

DETAILED DESCRIPTION

Figure 1:
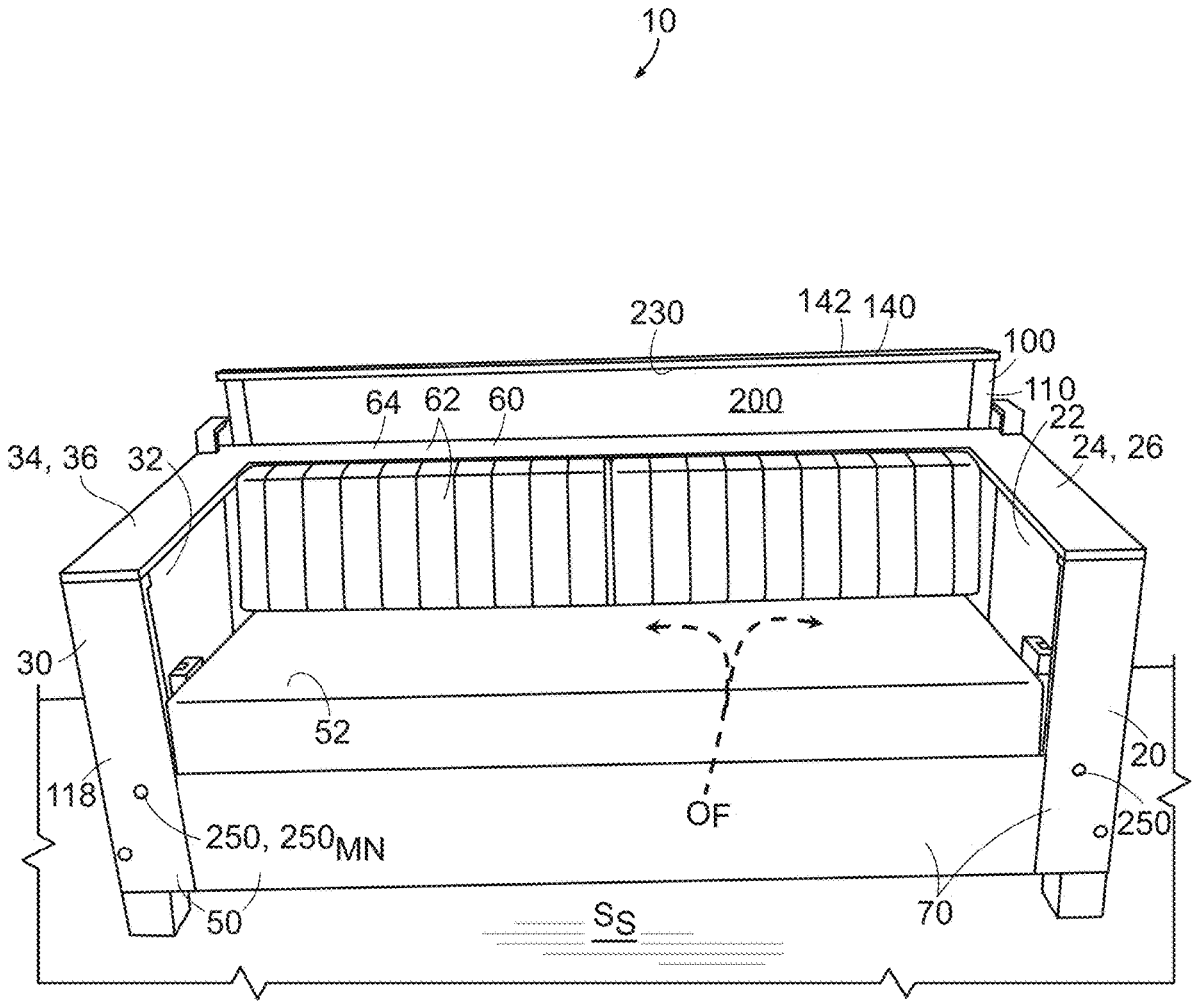
FIG. 1 is a front perspective view of a self-covering furniture unit configured for seating and including a weather-protective panel in a storage position behind a backrest so that a seating surface is exposed.

The following description of a variously configured self-covering outdoor furniture units is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to restrict the maximum scope of the claims.

Shown in the included drawings are various views of an illustrative self-covering furniture unit generally referenced by the reference number 10. Throughout the specification and drawings, like elements across alternative embodiments are referenced by similar or identical numeric and/or alphanumeric reference characters. Moreover, terms such "vertical," "horizontal," "lateral," "above," "below," "top," "bottom," "forward of," "rearward of," "back," and "front," as well as variants and synonyms of these and other spatially-indicative terms, are used as relative spatial-orienting references under the assumption that the self-covering furniture unit 10 is set upon a substantially horizontal support surface, such as the ground, a floor, a patio, or an elevated deck, in an orientation suitable for use as intended. "Horizontal" itself is used in a manner that is ubiquitously understood, but more technically regarded as being "normal" or "perpendicular" to a vector representative, for example, of a weight force directed downwardly and toward earth's center.

Figure 2:
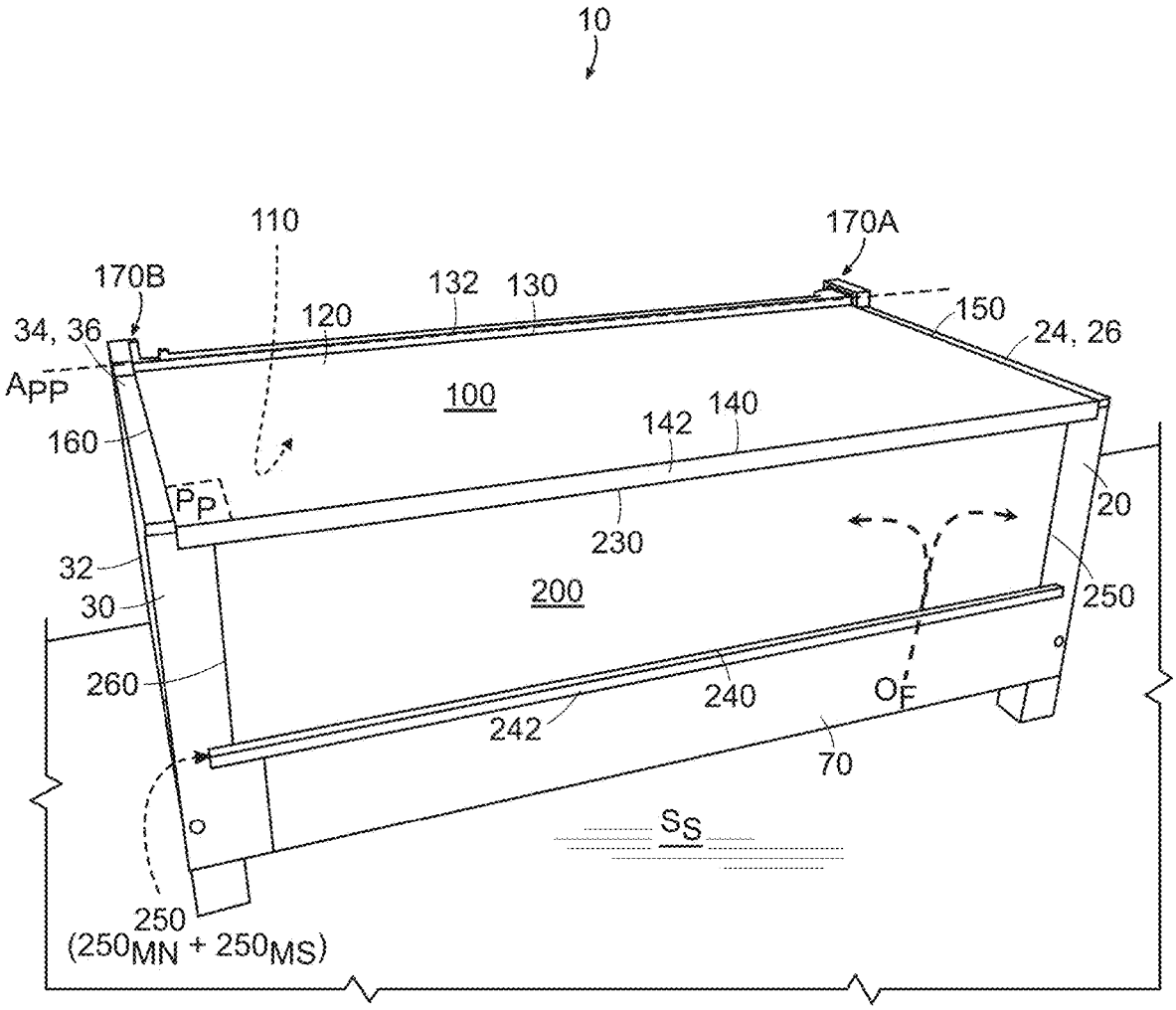
FIG. 2 is a front perspective view of the self-covering furniture unit shown in FIG. 1 wherein the weather-protective panel in a deployed position over the seating surface.

With initial reference to FIGS. 1 and 2, an illustrative embodiment of a self-covering-furniture unit 10 (alternatively, "furniture unit 10") includes a first side portion 20 having a first side wall 22 and a first-side upper surface 24. Laterally opposite the first side portion 20 is a second side portion 30 having a second side wall 32 and a second-side upper surface 34. The first-side and second-side upper surfaces 24 and 34 define, respectively, first and second armrests 26 and 36.

The furniture unit 10 further includes a base 50 configured for setting upon a substantially horizontal furniture-support surface $S_S$. The base 50 includes a seating surface 52 extending laterally between the first and second side portions 20 and 30. In the non-limitingly illustrative embodiment depicted throughout the drawings, the seating surface 52 is elongated to accommodate more than one seated person. Accordingly, the embodiment depicted may be regarded as a couch. However, as indicated in the summary, a furniture unit 10 configured as a chair for seating a single person is well within the scope captured in the appended claims, absent express language to the contrary.

The furniture unit 10 further includes a furniture-unit rear portion 60 along which a backrest 62 extends upwardly above the seating surface 52 to a backrest upper surface 64, and laterally between the first and second side portions 20 and 30. Opposite (e.g., across the seating surface 52 from) and forward of the furniture-unit rear portion 60 is a furniture-unit front face 70 that extends at least partially below the seating surface 52 and laterally between the first and second side portions 20 and 30. The seating surface 52 extends forwardly of the furniture-unit rear portion 60 and the backrest 62 toward the furniture-unit front face 70. At least a portion of the furniture-unit front face 70 extends behind the calves of a person (not shown) seated on the seating surface 52 with his or her feet set on the furniture-support surface $S_S$.

Referring still to FIGS. 1 and 2, as well as FIGS. 3-7, the furniture unit 10 further includes a self-supporting, substantially rigid weather-protective primary panel 100, which is alternatively and interchangeably referred to as the "primary panel 100." The primary panel 100 has opposed primary-panel inner and outer surfaces 110 and 120 that coextend along a panel plane PP between a primary-panel rearward-lower edge 130, a primary-panel forward-upper edge 140 opposite the rearward-lower edge 130, and laterally opposed panel first and second edges 150 and 160 that extend between the primary-panel rearward-lower and forward-upper edges 130 and 140. The primary panel 100 is oriented on the furniture unit 10 such that the primary-panel rearward-lower and forward-upper edges 130 and 140 extend laterally between the first and second side portions 20 and 30 of the furniture unit 10.

The primary panel 100 is displaceable between storage (open) and use (closed) positions which are depicted in, respectively, the front view of FIGS. 1 and 2. More specifically, the primary-panel rearward-lower edge 130 is retained for linear displacement behind the backrest 62, and along furniture-unit rear portion 60, between vertically opposed lowermost and uppermost positions. When the primary-panel rearward-lower edge 130 is disposed in the uppermost position, the primary panel 100 can be pivoted about a panel-pivot axis $A_{PP}$ between vertical and horizontal orientations. The vertical orientation is such that the primary-panel forward-upper edge 140 is disposed above the primary-panel rearward-lower edge 130, while the horizontal orientation is such that the forward-upper edge 140 is disposed forwardly of the rearward-lower edge 130.

The aforesaid linear displaceability and pivotability facilitates displacement of the primary panel 100 between the storage and deployed positions. In the storage (open) position, the primary panel 100 is vertically disposed behind the backrest 62 such that the panel plane PP is substantially perpendicular to the furniture-support surface $S_S$ with the primary-panel rearward-lower edge 130 in its lowermost position, as seen in the rear side view of FIG. 4, for example. In the deployed position shown in FIGS. 2 and 3, the primary panel 100 is horizontally disposed above the seating surface 52 such that the panel plane PP is substantially parallel to the furniture support surface $S_S$. In the version depicted, the deployed position is such that the primary panel 100 is supported above the seating surface 52 by, and extends between, the first-side and second-side upper surfaces 24 and 34. Moreover, the backrest upper surface 64 is substantially coplanar with the first-side and second-side upper surfaces 24 and 34 such that, in the deployed (closed) position, the weather-protective primary panel 100 is furthermore supported above the seating surface 52 by the backrest upper surface 64.

As shown in the drawings, the primary panel 100, when deployed, is disposed at an elevation higher than the seating surface 52. This positioning defines a frontal opening OF at the front of the furniture unit 10 that extends laterally between the first and second side portions 20 and 30 and vertically between the seating surface 52 and the panel inner surface 110. Left uncovered, the frontal opening OF renders the seating surface 52 exposed to blown debris and precipitation, as well as direct and reflected sunlight.

In order to selectively close off the frontal opening OF, the furniture unit 10 illustratively includes a weather-protective subsidiary panel 200, which is alternatively and interchangeably referred to as the "subsidiary panel 200." In the embodiment depicted, the subsidiary panel 200, which depends (e.g., hangs from) from the primary-panel forward-upper edge 140, is fabricated from a flexible material. More specifically, as embodied, the subsidiary panel 200 includes subsidiary-panel top edge 230 by which the subsidiary panel 200 is attached to the primary-panel forward-upper edge 140. Opposite the subsidiary-panel top edge 230 is a subsidiary-panel bottom edge 240. The subsidiary-panel top and bottom edges 230 and 240 extend substantially parallel to one another and laterally between laterally opposed subsidiary-panel first and second edges 250 and 260. The subsidiary-panel first and second edges 250 and 260 correspond to the primary-panel panel first and second edges 150 and 160.

As shown in various drawings, each of (i) the primary-panel rearward-lower edge 130, (ii) the primary-panel forward-upper edge 140, and (iii) the subsidiary-panel bottom edge 240 is provided with an elongated, laterally extending reinforcement member, designated respectively as first, second, and third reinforcement members 132, 142, and 242. Each of the first, second, and third reinforcement members 132, 142, and 242 provides rigidity to the edge of which it is attached or forms a part.

Figure 3:
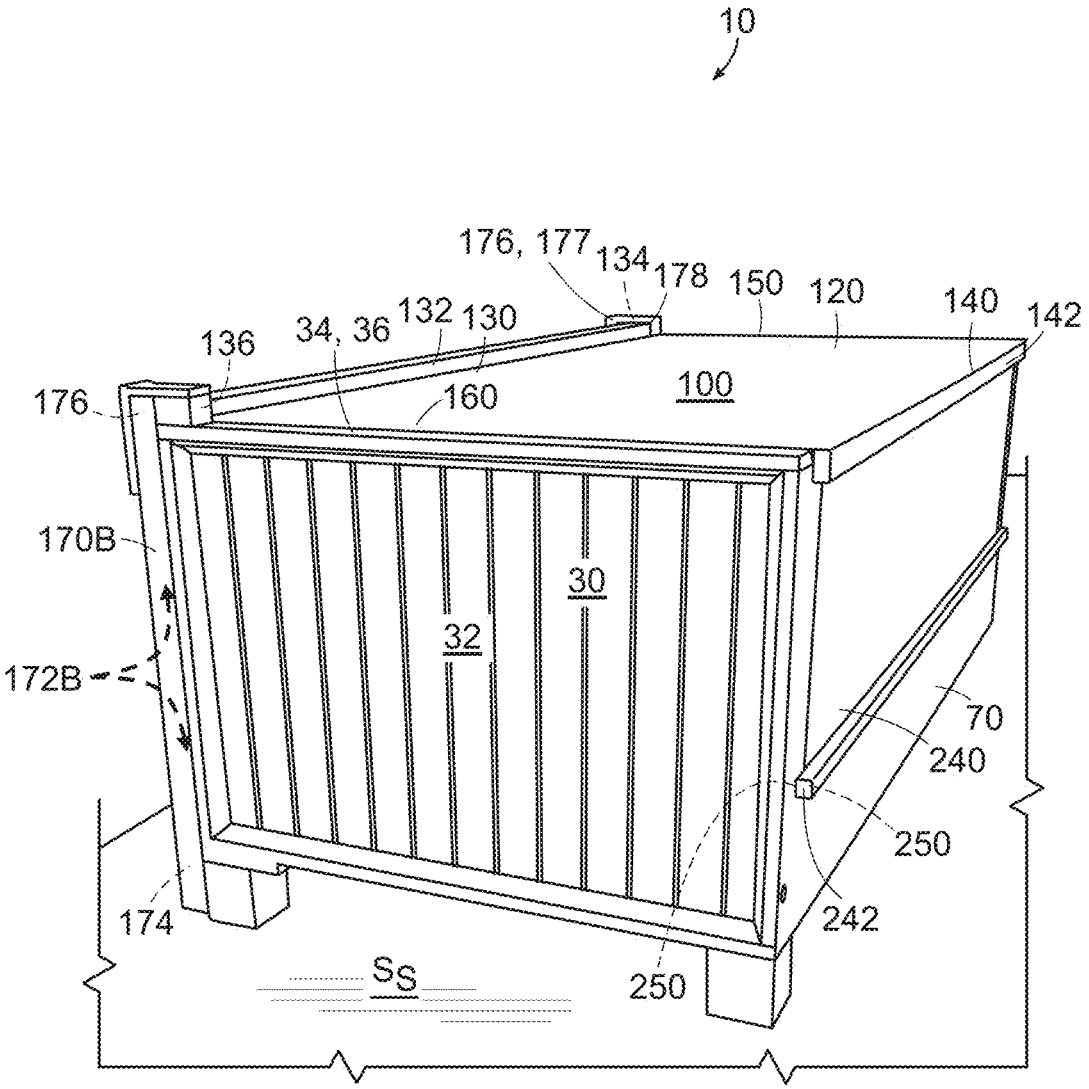
FIG. 3 is a side perspective view of the self-covering furniture unit shown in FIGS. 1 and 2 with the weather-protective panel in a deployed position.

The third reinforcement member 242 that is attached along the subsidiary-panel bottom edge 240 serves to both (i) keep the subsidiary-panel bottom edge 240 stretched out laterally and substantially parallel to the subsidiary-panel top edge 230 and (ii) provide weight to maintain the subsidiary panel 200 stretched out and hanging vertically in both its deployed and stored positions. As shown in FIGS. 2 and 3, for example, the subsidiary panel 200 is dimensioned such that, when the subsidiary and the primary panels 200 and 100 are in their deployed positions, the subsidiary-panel bottom edge 240 is situated below the seating surface 52 in order to cover the frontal opening OF, thereby shielding the seating surface 52 from debris, weather elements, and sunlight.

Although the weight provided by the third reinforcement member 242 assists in maintaining the subsidiary panel 200 in a deployed position over the frontal opening OF, the embodiment depicted illustratively includes attachment elements 250 configured for temporarily and removably retaining the subsidiary-panel bottom edge 240 in contacting engagement with the furniture-unit front face 70. It is especially advantageous for temporary securement of the subsidiary panel 200 to the furniture-unit front face 70 to be in—or at least include—locations below the seating surface 52. As mentioned in the summary, the attachment elements 250 may illustratively include at least one of (i) magnetic elements, (ii) a plurality of hook-and-loop fasteners such as those of the type commonly sold under the trademark Velcro®, and (iii) snaps. In the embodiment depicted, the attachment elements are magnetic elements 250 mN and 250 ms, wherein the subscripted portions of the reference characters "MN" and "MS" indicate opposite and mutually-attracting magnetic polarities (i.e., "M" for "magnetic," "N" for "north," and "S" for "south").

Figure 4:
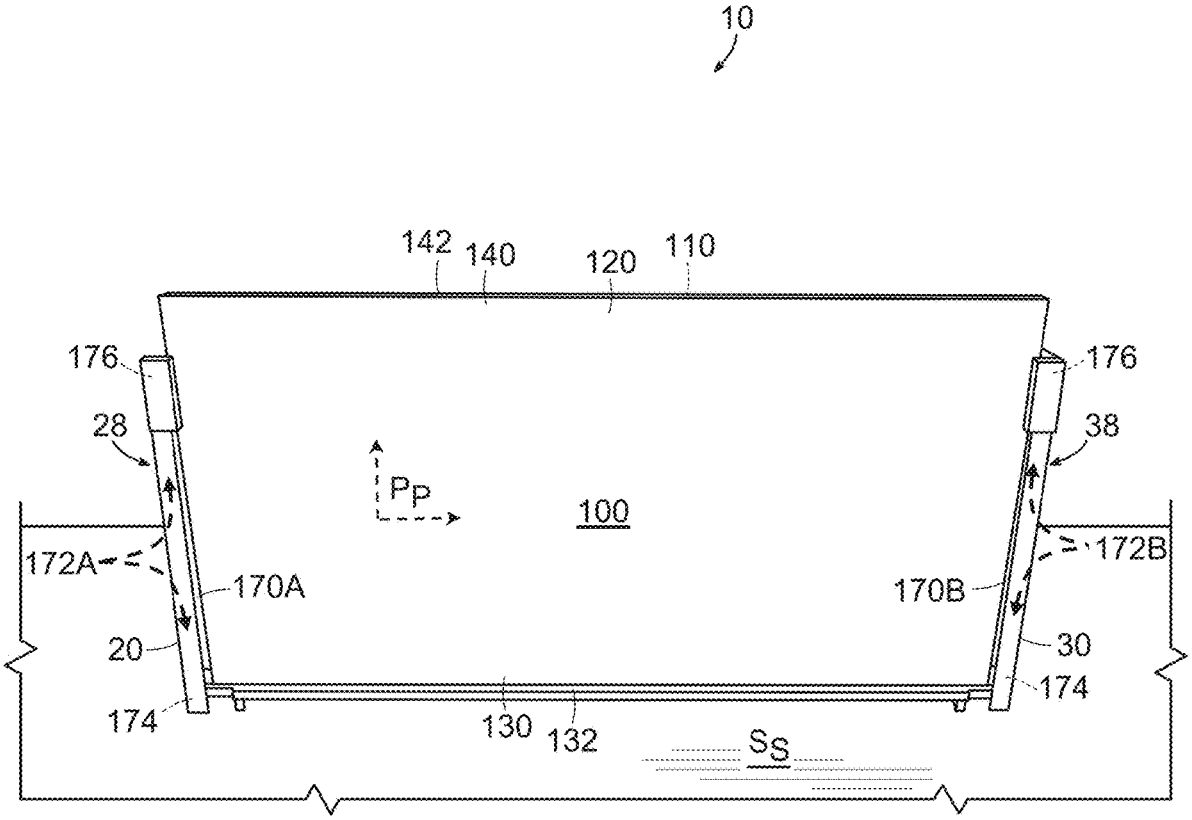
FIG. 4 is a rear view of the self-covering furniture unit shown in FIGS. 1-3 with the weather-protective panel in the storage position behind the backrest.

As described in the summary, and earlier in the detailed description, the primary-panel rearward-lower edge 130 is retained for linear vertical displacement behind the backrest 62 between the lowermost and uppermost positions. To this end, the furniture-unit rear portion 60 includes laterally opposed and spatially separated first-side and second-side guide members 170A and 170B. Illustratively configured, the first and second side portions 20 and 30 of the furniture unit 10 include, respectively, first-side and second-side rear surfaces 28 and 38, which may be regarded as sub-surfaces/sub-portions of the overall the furniture-unit rear portion 60. As shown in FIG. 4, for example, attached, defined by, or otherwise carried by the first-side and second-side rear surfaces 28 and 38 are, respectively, the first-side and second-side guide members 170A and 170B. In the version depicted throughout the various drawings, the guide members 170A and 170B define vertically extending channels 172A and 172B.

As shown in FIGS. 2, 3, 5, and 7, the first reinforcement member 132 extends laterally beyond each of the opposed primary-panel first and second edges 150 and 160 so as to define, respectively, rearward-lower edge first and second protrusions 134 and 136. The first and second protrusions 134 and 136 functionally cooperate with, respectively, the first-side and second-side guide members 170A and 170B. Specifically, the first and second protrusions 134 and 136 project into, respectively, the channels 172A and 172B of the first-side and second-side guide members 170A and 170B such that the guide members 170A and 170B define the path of vertical displacement along which the rearward-lower edge 130 is selectively movable between the lowermost and uppermost positions 174 and 176.

Figure 5:
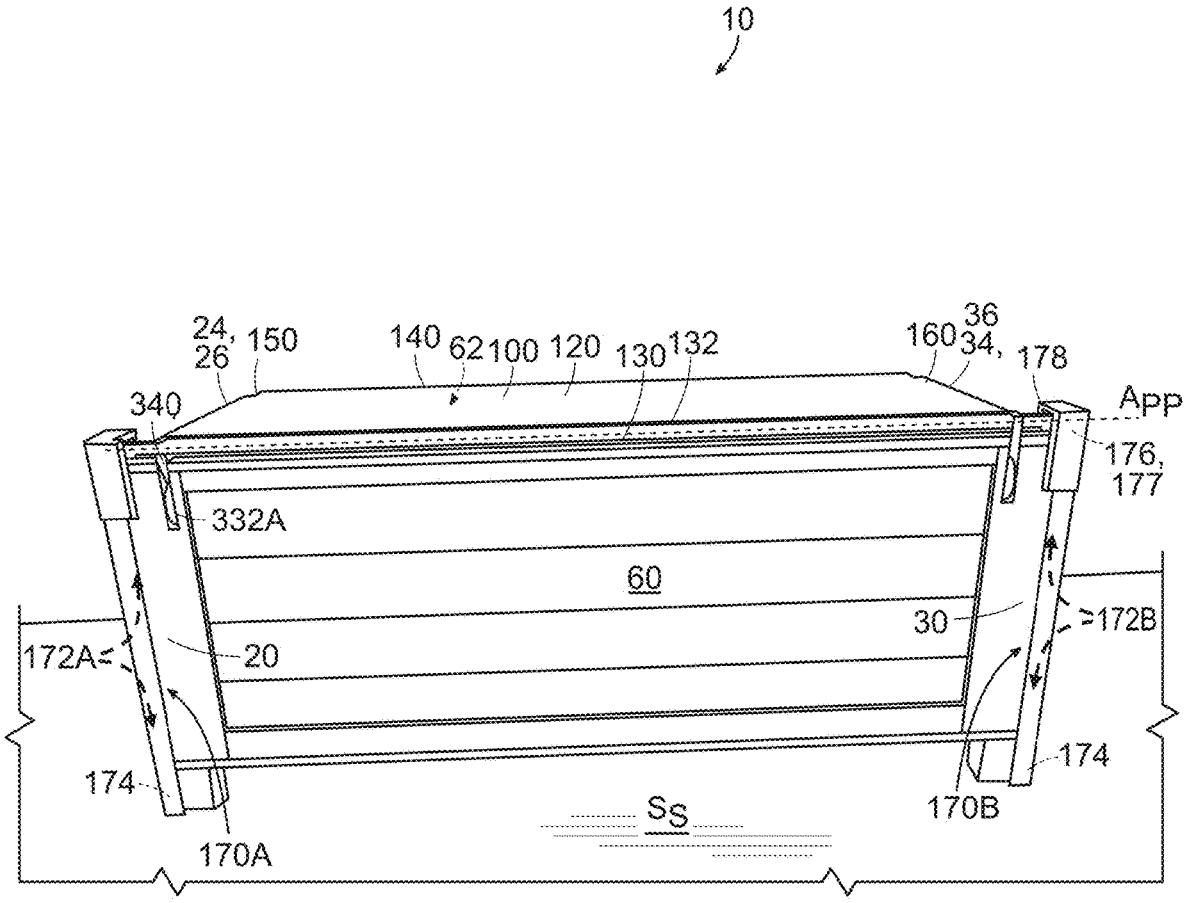
FIG. 5 is a rear view of the self-covering furniture unit shown in FIGS. 1-4 with the weather-protective panel in the deployed position over the seating surface.
Figure 7:
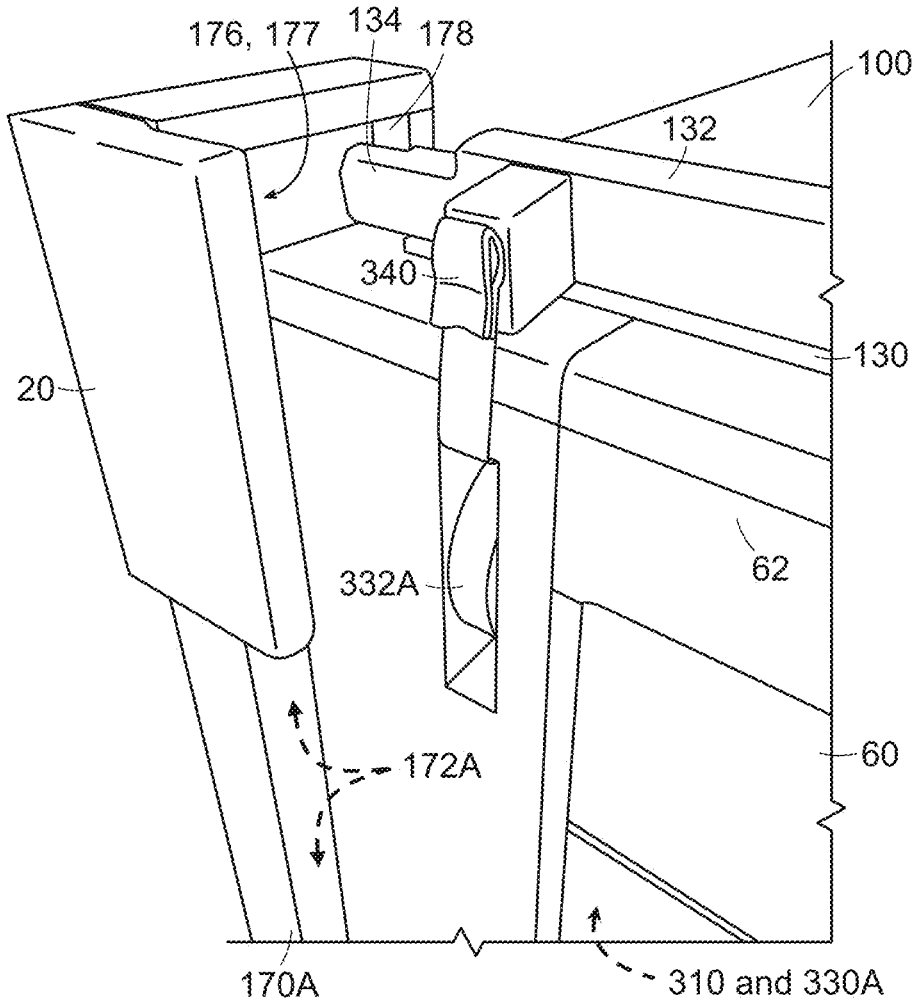
FIG. 7 is a detailed closeup view of selected lift-assist system components as view from the rear of the furniture unit.

In addition to facilitating vertical displacement of the primary-panel rearward-lower edge 130, the embodiment depicted further facilitates—to a much more limited extent—horizontal displacement when the rearward-lower edge 130 is in the uppermost position 176. More specifically, as shown in FIGS. 3, 5, and 7, the primary-panel rearward-lower edge 130, and the associated first reinforcement member 132, can be linearly displaced between rearward and forward positions 177 and 178 along a horizontal path defined by the first-side and second-side guide members 170A and 170B. When the primary panel 100 is displaced vertically upward from its storage position, and the panel rearward-lower edge 130 attains its uppermost position 176, the primary panel 100 can be both pivoted and linearly displaced forwardly toward the deployed position. In the version depicted, each of the channels 172A and 172B extends horizontally and forwardly for a distance that is short relative to its vertical extent, such that each of the channels 172A and 172B exhibits the shape of an inverted capital "L." Moreover, in this illustrative configuration of the first-side and second-side guide members 170A and 170B, the uppermost position 176 corresponds to the rearward position 177 of the primary-panel rearward-lower edge 130 defined by first-side and second-side guide members 170A and 170B.

As described at some length in the summary, within the scope and contemplation of the invention as defined in various claims appended hereto are variations of the furniture unit 10 including a lift-assist system for reducing the apparent weight of (i.e., negating a portion of the weight force exerted downwardly by) the primary panel 100. Also previously discussed was that such a system may be configured in any of various ways, but that a lift-assist system employing one or more springs for the selective storage of potential energy is particularly advantageous.

Figure 6:
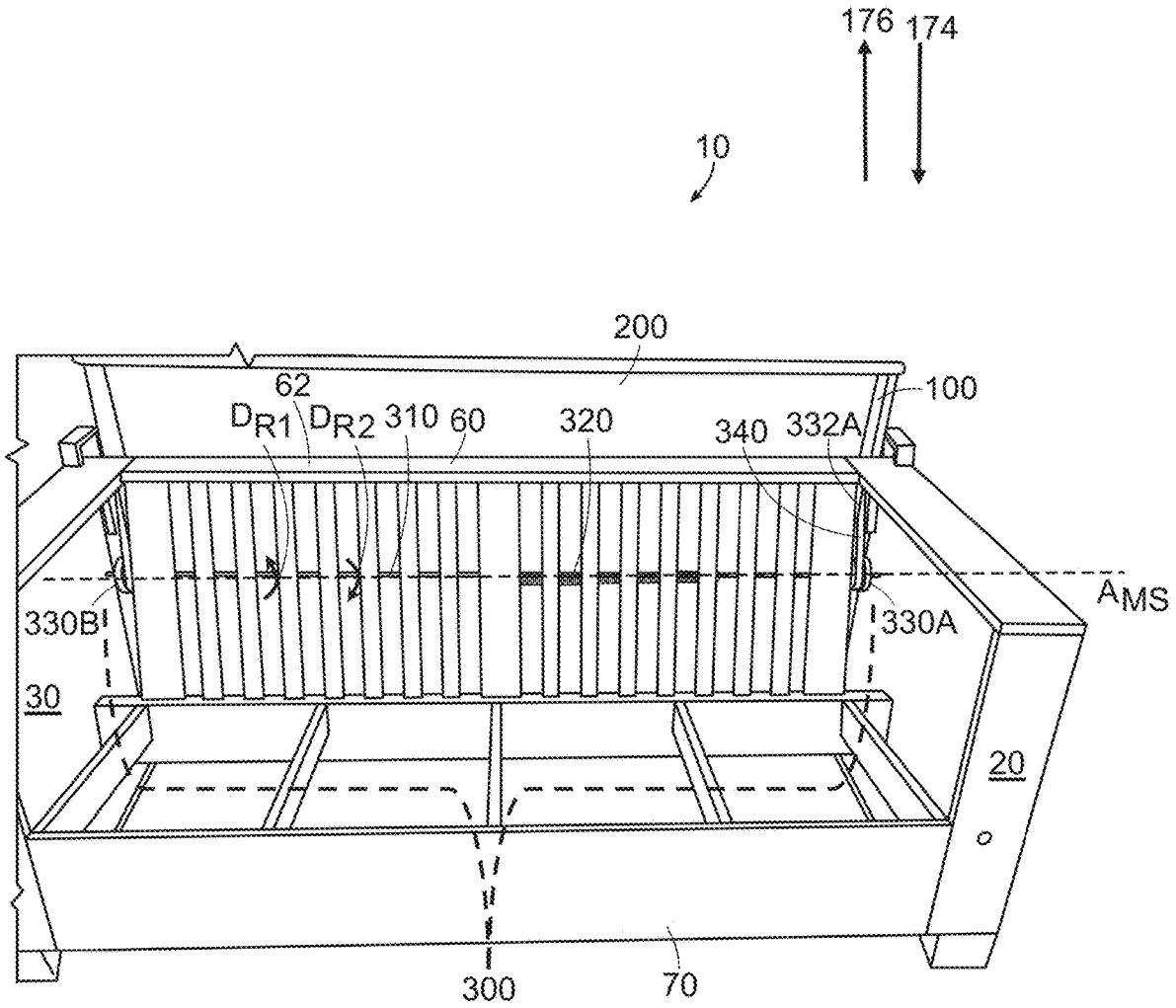
FIG. 6 is a front perspective view of a self-covering furniture unit of FIGS. 1-5 with the weather-protective panel in the storage position behind the backrest and seat cushions removed to reveal components of lift-assist system configured to assist a user in deploying the weather-protect panel.

With reference to FIGS. 6 and 7, a lift-assist system 300 non-limitingly illustrative of the overall inventive concept is described. In the front view of FIG. 6, seat and backrest cushions have been removed to expose mechanisms of the lift-assist system 300 through structural slats (not specially numbered) forming parts of the backrest 62. The lift-assist system 300 includes a main shaft 310 mounted behind the backrest 62 of the furniture unit 10. The main shaft 310 is secured for bidirectional rotation about a main-shaft rotation axis $A_{MS}$ along which the main shaft 310 extends lengthwise, and laterally between the first and second side portions 20 and 30 of the furniture unit 10.

Helically disposed about a portion of the lengthwise extent of the main shaft 310 is a torsion spring 320. While a basic embodiment need only include a single drive pulley, the illustrative version depicted includes first and second drive pulleys 330A and 330B affixed to the main shaft 310 for rotation about the main-shaft rotation axis $A_{MS}$ in tandem with the main shaft 310. In order to provide balanced and efficient lift assistance, the first and second drive pulleys 330A and 330B are laterally spaced along the main shaft 310 such that the first drive pulley 330A is located in proximity to the first side portion 20 and the second drive pulley 330B is located in proximity to the second side portion 30. Because only a single drive pulley is required to enable functionality of an embodiment of the general type depicted, the remainder of the description focuses primarily on the first drive pulley 330A, and subsequently introduced components associated with the first drive pulley 330A. It is to be understood that similar and analogous components would be associated with the second drive pulley 330B and, therefore, illustrating, reference numbering, and describing components associated with the first drive pulley 330A provides the disclosure required to support enablement of additional iterations of the same.

A first flexible linkage 340 mechanically linking the first drive pulley 330A to the primary panel 100 enables the transfer of energy and force between the torsion spring 320 and the primary panel 100. More specifically, by means of the first flexible linkage 340, rotation of the main shaft 310 in a first rotation $D_{R1}$ direction causes the torsion spring 320 to deform from a first configuration toward a second configuration and store potential energy. Rotation of the main shaft 310 in a second rotation direction $D_{R2}$ opposite the first rotation direction $D_{R1}$ causes the torsion spring 320 to return from the second configuration toward the first configuration and release potential energy. The first flexible linkage 340 is linked to the first drive pulley 330A and the primary panel 100 such that (i) as the primary panel 100 is vertically displaced toward the lowermost position 174 for storage, the main shaft 310 is rotated in the first rotation direction $D_{R1}$ in order to cause the torsion spring 320 to "wind up" and store potential energy and (ii) as the primary panel 100 is vertically displaced away from the lowermost position 174 toward the uppermost position 176 for deployment, the main shaft 310 is rotated in the second rotation direction $D_{R2}$ as the torsion spring 320 releases stored potential energy. The release of this stored potential energy, harnessed in the manner described, assists a user in lifting the primary panel 100 by reducing the apparent weight of said primary panel 100.

In a most basic configuration, transfer of energy and force from and between the torsion spring 320 and the primary panel 100 is channeled generally along a single path direction through the first flexible linkage 340. However, in the illustrative version depicted, the path of the energy transfer and associated forces is redirected by a first idler pulley 332A. In this case, the first idler pulley 332A essentially reverses the direction of forces exchanged between the torsion-spring driven main shaft 310 and the primary panel 100. In this example, this was a design choice so that the main shaft 310 could be advantageously located along the furniture-unit rear portion 60. It will be readily appreciated that the examples discussed and depicted are merely illustrative, and that similar components arranged differently may be configured to achieve the desired functionality described.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A self-covering outdoor furniture unit configured for human seating, and comprising:

a first side portion having a first side wall and a first-side upper surface;

a second side portion having a second side wall and a second-side upper surface;

a base configured for resting upon a substantially horizontal furniture-support surface, the base including a seating surface extending laterally between the first and second side portions and being configured to accommodate at least one seated person thereon;

a backrest extending upwardly above the seating surface and laterally between the first and second side portions;

a self-supporting, substantially rigid weather-protective primary panel having opposed panel inner and outer surfaces that coextend along a panel plane between a primary-panel rearward-lower edge, a primary-panel forward-upper edge opposite the rearward-lower edge, and laterally opposed primary-panel first and second edges that extend between the primary-panel rearward-lower and forward-upper edges, wherein (a) the primary-panel rearward-lower edge is retained for linear displacement behind the backrest between a lowermost position and an uppermost position;

(b) when the primary-panel rearward-lower edge is disposed in the uppermost position, the weather-protective primary panel can be pivoted about a panel-pivot axis between vertical and horizontal orientations relative to the furniture-support surface, the vertical orientation being such that the primary-panel forward-upper edge is disposed above the primary-panel rearward-lower edge and the horizontal orientation being such that the primary-panel forward-upper edge is disposed forwardly of the primary-panel rearward-lower edge; and (c) by virtue of the aforesaid linear displaceability and pivotability, the weather-protective primary panel can be linearly and pivotably displaced between (i) a storage position in which the weather-protective primary panel is vertically disposed behind the backrest such that the panel plane is substantially perpendicular to the furniture-support surface with the primary-panel rearward-lower edge in its lowermost position and (ii) a deployed position in which the weather-protective primary panel is horizontally disposed above the seating surface such that the panel plane is substantially parallel to the furniture support surface.

2. The outdoor furniture unit of claim 1 wherein, when the primary weather-protective panel is in the deployed position, it is supported above the seating surface by, and extends between, at least the first-side and second-side upper surfaces.

3. The outdoor furniture unit of claim 2 wherein (a) the backrest includes a backrest upper surface that is substantially coplanar with the first-side and second-side upper surfaces and (b) when the weather-protective primary panel is in the deployed position, it is furthermore supported above the seating surface by the backrest upper surface.

4. The outdoor furniture unit of claim 3 wherein the first-side and second-side upper surfaces define armrests.

5. The outdoor furniture unit of claim 2 wherein the first-side and second-side upper surfaces define armrests.

6. The outdoor furniture unit of claim 2 further comprising a weather-protective subsidiary panel including a subsidiary-panel top edge by which the subsidiary panel is attached to and depends from the primary panel along the primary-panel upper-forward edge, a subsidiary-panel bottom edge opposite the subsidiary-panel top edge, and laterally opposed subsidiary-panel first and second edges between which the subsidiary-panel top and bottom edges laterally extend substantially parallel to one another, wherein (a) the subsidiary-panel first and second edges generally correspond to the primary-panel first and second edges, and (b) the subsidiary panel is dimensioned such that, when the primary panel is in a deployed position, the subsidiary panel can assume a deployed position in which the subsidiary-panel bottom edge is situated below at least the seating surface.

7. The outdoor furniture unit of claim 6 wherein the subsidiary panel is fabricated from a material that is flexible relative to the material from which the primary panel is fabricated.

8. The outdoor furniture unit of claim 7 further including a furniture-unit front face and attachment elements configured for temporarily and removably retaining the subsidiary-panel bottom edge in contacting engagement with the furniture-unit front face.

9. The outdoor furniture unit of claim 8 wherein the attachment elements comprise at least one of (i) magnetic elements, (ii) hook-and-loop fasteners, and (iii) snaps.

10. The outdoor furniture unit of claim 1 further comprising a lift-assist system that is mechanically linked to the weather-protective primary panel and selectively (i) stores potential energy of increasing magnitude as the weather-protective primary panel and primary-panel rearward-lower edge are vertically displaced toward, respectively, the storage and lowermost positions and (ii) releases stored potential energy as the weather-protective primary panel and primary-panel rearward-lower edge are vertically displaced toward, respectively, the deployed and uppermost positions such that the apparent weight of the weather-protective primary panel is reduced by the release of the potential energy stored by the lift-assist system.

11. The outdoor furniture unit of claim 10 wherein the lift-assist system selectively stores potential energy through deformation of at least one spring.

12. The outdoor furniture of claim 11 wherein the at least one spring by which potential energy is selectively stored and released is a torsion spring.

13. The outdoor furniture unit of claim 11 wherein the lift-assist system comprises:

a main shaft mounted behind the backrest of the furniture unit for bidirectional rotation about a main-shaft rotation axis along which the main shaft extends lengthwise, and laterally between the first and second side portions of the furniture unit;

a torsion spring helically disposed about a portion of the lengthwise extent of the main shaft;

at least a first drive pulley affixed to the main shaft for rotation about the main-shaft rotation axis in tandem with the main shaft; and at least a first flexible linkage mechanically linking the first drive pulley to the weather-protective primary panel, further wherein (a) rotation of the main shaft in a first rotation direction causes the torsion spring to deform from a first configuration toward a second configuration and store potential energy;

(b) rotation of the main shaft in a second rotation direction opposite the first rotation direction causes the torsion spring to return from the second configuration toward the first configuration and release potential energy; and (c) the first flexible linkage is linked to the first drive pulley and the weather-protective primary panel such that (i) as the primary panel is vertically displaced toward the storage position, the main shaft is rotated in the first rotation direction in order to cause the torsion spring to store potential energy and (ii) as the primary panel is vertically displaced away from the storage position, the main shaft is rotated in the second rotation direction in order to cause the torsion spring to release stored potential energy and assist a user lifting the primary panel by reducing the apparent weight of said primary panel.

14. The outdoor furniture unit of claim 13 wherein, when the primary weather-protective panel is in the deployed position, it is supported above the seating surface by, and extends between, at least the first-side and second-side upper surfaces.

15. The outdoor furniture unit of claim 14 further comprising a weather-protective subsidiary panel including a subsidiary-panel top edge by which the subsidiary panel is attached to and depends from the primary panel along the primary-panel upper-forward edge, a subsidiary-panel bottom edge opposite the subsidiary-panel top edge, and laterally opposed subsidiary-panel first and second edges between which the subsidiary-panel top and bottom edges laterally extend substantially parallel to one another, wherein (a) the subsidiary-panel first and second edges generally correspond to the primary-panel first and second edges, (b) the subsidiary panel is dimensioned such that, when the primary panel is in a deployed position, the subsidiary panel can assume a deployed position in which the subsidiary-panel bottom edge is situated below at least the seating surface, (c) the subsidiary panel is fabricated from a material that is flexible relative to the material from which the primary panel is fabricated, and (d) the furniture unit further includes a furniture-unit front face and attachment elements configured for temporarily and removably retaining the subsidiary panel in contacting engagement with the furniture-unit front face.

16. The outdoor furniture unit of claim 15 wherein, when the primary weather-protective panel is in the deployed position, it is supported above the seating surface by, and extends between, at least the least the first-side and second-side upper surfaces.

17. The outdoor furniture unit of claim 15 wherein the first-side and second-side upper surfaces define armrests.

18. The outdoor furniture unit of claim 16 wherein (a) the backrest includes a backrest upper surface that is substantially coplanar with the first-side and second-side upper surfaces and (b) when the weather-protective primary panel is in the deployed position, it is furthermore supported above the seating surface by the backrest upper surface.

19. A self-covering outdoor furniture unit configured for human seating, and comprising:

a first side portion having a first side wall and a first-side upper surface defining a first armrest;

a second side portion having a second side wall and a second-side upper surface defining a second armrest;

a base configured for resting upon a substantially horizontal furniture-support surface, the base including a seating surface extending laterally between the first and second side portions and being configured to accommodate at least one seated person thereon;

a furniture-unit rear portion including a backrest extending upwardly above the seating surface and laterally between the first and second side portions, the backrest including a backrest upper surface that is substantially coplanar with the first-side and second-side upper surfaces;

a furniture-unit front face opposite and forward of the furniture-unit rear portion, the furniture-unit front face extending at least partially below the seating surface and laterally between the first and second side portions;

a self-supporting, substantially rigid weather-protective primary panel having opposed panel inner and outer surfaces that coextend along a panel plane between a primary-panel rearward-lower edge, a primary-panel forward-upper edge opposite the rearward-lower edge, and laterally opposed primary-panel first and second edges that extend between the primary-panel rearward-lower and forward-upper edges, wherein (a) the primary-panel rearward-lower edge is retained for linear displacement behind the backrest between a lowermost position and an uppermost position;

(b) when the primary-panel rearward-lower edge is disposed in the uppermost position, the weather-protective primary panel can be pivoted about a panel-pivot axis between vertical and horizontal orientations relative to the furniture-support surface, the vertical orientation being such that the primary-panel forward-upper edge is disposed above the primary-panel rearward-lower edge and the horizontal orientation being such that the primary-panel forward-upper edge is disposed forwardly of the primary-panel rearward-lower edge;

(c) by virtue of the aforesaid linear displaceability and pivotability, the weather-protective primary panel can be linearly and pivotably displaced between (i) a storage position in which the weather-protective primary panel is vertically disposed behind the backrest such that the panel plane is substantially perpendicular to the furniture-support surface with the primary-panel rearward-lower edge in its lowermost position and (ii) a deployed position in which the weather-protective primary panel is horizontally disposed above the seating surface such that the panel plane is substantially parallel to the furniture support surface; and (d) when the primary weather-protective panel is in the deployed position, it is supported above the seating surface by the backrest upper surface and the first-side and second-side upper surfaces.

20. The outdoor furniture unit of claim 18 further comprising a weather-protective subsidiary panel including a subsidiary-panel top edge by which the subsidiary panel is attached to and depends from the primary panel along the primary-panel upper-forward edge, a subsidiary-panel bottom edge opposite the subsidiary-panel top edge, and laterally opposed subsidiary-panel first and second edges between which the subsidiary-panel top and bottom edges laterally extend substantially parallel to one another, wherein (a) the subsidiary-panel first and second edges generally correspond to the primary-panel first and second edges, (b) the subsidiary panel is dimensioned such that, when the primary panel is in a deployed position, the subsidiary panel can assume a deployed position in which the subsidiary-panel bottom edge is situated below at least the seating surface, (c) the subsidiary panel is fabricated from a material that is flexible relative to the material from which the primary panel is fabricated, and (d) attachment elements configured for temporarily and removably retaining the subsidiary panel in contacting engagement with the furniture-unit front face.

21. The outdoor furniture unit of claim 19 further comprising a lift-assist system that is mechanically linked to the weather-protective primary panel and selectively (i) stores potential energy of increasing magnitude as the weather-protective primary panel and primary-panel rearward-lower edge are vertically displaced toward, respectively, the storage and lowermost positions and (ii) releases stored potential energy as the weather-protective primary panel and primary-panel rearward-lower edge are vertically displaced toward, respectively, the deployed and uppermost positions such that the apparent weight of the weather-protective primary panel is reduced by the release of the potential energy stored by the lift-assist system.

* * * * *